United States Patent [19]

Ohashi et al.

[11] Patent Number: 4,702,999

[45] Date of Patent: Oct. 27, 1987

[54] SILVER HALIDE PHOTOGRAPHIC LIGHT-SENSITIVE MATERIALS

[75] Inventors: Minoru Ohashi; Satoshi Kaneko, both of Nagaokakyo, Japan

[73] Assignee: Mitsubishi Paper Mills, Ltd., Tokyo, Japan

[21] Appl. No.: 832,422

[22] Filed: Feb. 24, 1986

[30] Foreign Application Priority Data

Feb. 25, 1985 [JP] Japan ..... 60-37270
Feb. 25, 1985 [JP] Japan ..... 60-37271

[51] Int. Cl.[4] ..... G03C 1/34
[52] U.S. Cl. ..... 430/445; 430/611; 430/957; 430/448
[58] Field of Search ..... 430/611, 957, 445, 448

[56] References Cited

U.S. PATENT DOCUMENTS

| | | | |
|---|---|---|---|
| 2,824,001 | 2/1958 | Allen et al. | 430/611 |
| 3,674,478 | 7/1972 | Grasshoff et al. | 430/219 |
| 4,416,977 | 11/1983 | Ohashi et al. | 430/611 |
| 4,420,554 | 12/1983 | Ohashi et al. | 430/611 |

FOREIGN PATENT DOCUMENTS 53-48723 5/1978 Japan .

*Primary Examiner*—Won H. Louie
*Attorney, Agent, or Firm*—Cushman, Darby & Cushman

[57] ABSTRACT

Disclosed are novel antifoggant precursors having the general formula (I) or (II) which are sufficiently stable in a wealkyl acidic medium, are markedly effective in restraining over-development fog and besides cause little loss of sensitivity:

(I)

(wherein Y represents oxygen atom or

X represents $OR_3$ when Y is oxygen atom and $R_3$ when Y is where $R_1$ and $R_2$ each represents hydrogen atom, alkyl group aryl group and $R_3$ represents hydrogen atom, alkyl group or phenyl group; $R_4$–$R_6$ each represent hydrogen atom, halogen atom, alkyl group, carboxyl group, alkoxycarbonyl group or phenyl group, $R_4$ and $R_5$ may form together a benzene ring; $R_7$ represents hydrogen atom, alkyl group or phenyl group; and A represents a heterocyclic group of the mercapto antifoggant.)

(II)

(wherein X, Y, $R_4$–$R_5$ and A are the same as defined for the general formula (I) and $R_4$ and $R_5$ or $R_5$ and $R_6$ may form together a benzene ring.).

7 Claims, No Drawings

SILVER HALIDE PHOTOGRAPHIC LIGHT-SENSITIVE MATERIALS

BACKGROUND OF THE INVENTION

This invention relates to a photographic light-sensitive material having a silver halide emulsion layer stabilized against over-development fogging.

When a silver halide photographic light-sensitive material is subjected to development treatment under strong conditions, for example, at relatively high temperatures or with a highly active developer (having a high temperature and a high pH) for a very short time, there is the possibility of silver halide grains containing no latent image centers being also reduced.

The fog produced by the undesirable reduction of unexposed silver halide grains under the above conditions ordinarily appears especially strongly at the time of completion of development and is called over-development fog.

Antifoggants known to be effective in restraining the over-development fog are mercury compounds and heterocyclic mercapto compounds. These antifoggants reduce fog during development or over-development, but they also have the drawback of decreasing the sensitivity of silver halide photographic light-sensitive materials when added in an amount enough to reduce the fog.

The fundamental disadvantage of direct addition of heterocyclic mercapto compounds which are per se especially effective on over-development fog to silver halide emulsions is that they are already completely active at the time of addition thereof, namely, they are already completely active during preparation, storage and development.

They, they exert undesirable desensitization action during the periods of preparation and storage of the photographic light-sensitive materials.

In order to obviate these problems an attempt has been made to protect the mercapto group of these compounds by a suitable hydrolyzable group thereby to cause them to remain inactive for the period during which the action thereof is not desired to exert (the whole period prior to development including preparation period) while the activity is restored by hydrolysis with alkali during development. Such substituent groups are normally thioesters or thioethers of the mercapto antifoggants.

As the substituent groups of thioester type, thioesters of carboxylic acids, sulfonic acids and carbonate derivatives are disclosed in many patents, e.g., German Pat. No. 1,597,503, U.S. Pat. No. 3,260,597 and German Laid-Open Patent Application No. 2,061,972. However, these thioesters have the defect that they are hydrolyzed in an alkali medium of developing solution, but they also undergo gradual partial hydrolysis in neutral or weakly acidic pH region. Therefore, those thioester type antifoggants can be added in an inactive form to emulsion, but they may exert undesired desensitizing action due to the partial hydrolysis if the periods of preparation of emulsion and storage of photographic light-sensitive material are considerably long.

On the other hand, antifoggants having thioether type substituent, for example, those disclosed in U.S. Pat. No. 2,981,624 and U.S. Pat. No. 3,260,597 and German Pat. No. 1,173,796 are stable in neutral or weakly acidic medium, but they do not reproduce the original mercapto antifoggants at all or reproduce only very slowly and thus cannot effectively prevent the over-development fog.

Furthermore, those which are disclosed in U.S. Pat. No. 3,674,478, namely, compounds which release a mercapto antifoggant and form quinone-methide or naphthoquinone-methide in the presence of alkali rapidly release the mercapto antifoggant in the presence of alkali and are effective in prevention of over-development fog, but are somewhat unstable in a weakly acidic medium and only slowly release the antifoggant.

Therefore, when the period of from preparation to coating of emulsion (pH of the emulsion is weakly acidic) is sufficiently long, the antifoggant is released resulting in the undesired desensitization.

Furthermore, even if said compound in a complete form to emulsion, a greater loss of sensitivity is brought about as compared with the sensitivity obtained without the antifoggant although some increase may be seen as compared with the sensitivity when an active mercapto antifoggant is added.

Thus, addition of such compounds makes only a slight contribution to increase in sensitivity of silver halide photographic light-sensitive materials.

SUMMARY OF THE INVENTION

One object of this invention is to provide an antifoggant which is completely stable in neutral or weakly acidic pH region, but releases an antifoggant active to the desired extent in an alkaline pH region (during development) to prevent over-development fog and besides which causes a little loss of sensitivity. This antifoggant will be called an antifoggant precursor.

DESCRIPTION OF THE INVENTION

The inventors have made intensive researches on the above stated problems and have now discovered that the thioether type antifoggant precursors represented by the following general formula (I) or (II) meet the above requirements.

Especially, antifoggant precursors having remarkable effectiveness which has never been expected from U.S. Pat. No. 3,674,478 have been found.

That is, the precursors of this invention are novel compounds unexpected from said patent which are also sufficiently stable in a weakly acidic medium, are markedly effective in restraining over-development fog and besides cause little loss of sensitivity (as compared with when no antifoggant is added).

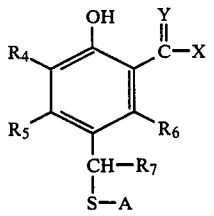

(I)

(wherein Y represents oxygen atom or

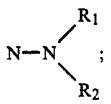

;

X represents $OR_3$ when Y is oxygen atom and $R_3$ when Y is

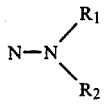

where $R_1$ and $R_2$ each represent hydrogen atom, alkyl group or aryl group and $R_3$ represents hydrogen atom, alkyl group or phenyl group; $R_4$–$R_6$ each represent hydrogen atom, halogen atom, alkyl group, carboxyl group, alkoxycarbonyl group or phenyl group, $R_4$ and $R_5$ may form together a benzene ring; $R_7$ represents hydrogen atom, alkyl group or phenyl group; and A represents a heterocyclic group of the mercapto antifoggant.)

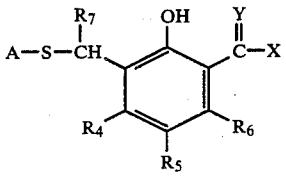

(II)

(wherein X, Y, $R_4$–$R_7$ and A are the same as defined for the general formula (I) and $R_4$ and $R_5$ or $R_5$ and $R_6$ may form together form a benzene ring.).

In the above formulas (I) and (II), the alkyl groups of $R_1$–$R_7$ are preferably substituted or unsubstituted alkyl group of 1–10 carbon atoms.

The mercapto antifoggants used in this invention may be any of those which have antifoggant action, but particularly preferred are five- or six-membered nitrogen-containing heterocyclic compounds which have a sulfur atom attached to a carbon atom adjacent to a nitrogen atom in the heterocyclic ring.

As typical examples of the heterocyclic ring, mention may be made of tetrazole ring, 1,2,4-triazole ring, benzoxazole ring, benzthiazole ring, benzimidazole ring, pyridine ring, pyrimidine ring, etc.

The following are nonlimiting typical examples of the antifoggants of the general formula (I) or (II) of this invention.

Examples of the compounds represented by the general formula (I)

| No. | A | X | Y | $R_4$ | $R_5$ | $R_6$ | $R_7$ |
|---|---|---|---|---|---|---|---|
| 1 | 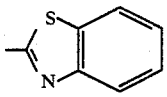 | $-OC_2H_5$ | O | —H | —H | —H | —H |
| 2 | 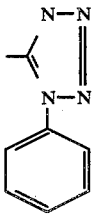 | —OH | O | —H | —H | —H | —H |
| 3 | 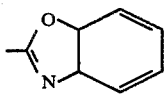 | $-OCH_2-CH_2OH$ | O | 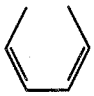 | | —H | 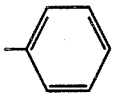 |
| 4 | 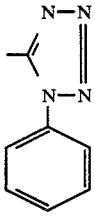 | $-OCH_3$ | O | —H | —H | —H | —H |
| 5 | 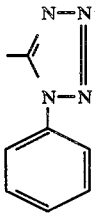 | $-OCH_2-CH_2-CH_2-CH_3$ | O | —H | —H | —H | —H |

-continued
Examples of the compounds represented by the general formula (I)
| No. | A | X | Y | $R_4$ | $R_5$ | $R_6$ | $R_7$ |
|---|---|---|---|---|---|---|---|
| 6 | 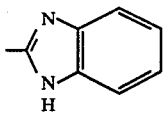 | $-OC_2H_5$ | O | 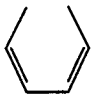 | | $-H$ | $-H$ |
| 7 | 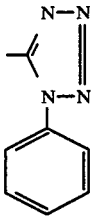 | $-O-CH_2-CH_2-CH(CH_3)_2$ | O | $-H$ | $-H$ | $-H$ | $-H$ |
| 8 | 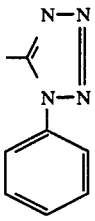 | $-O-CH_2-CH_2-OH$ | O | $-H$ | $-H$ | $-H$ | $-H$ |
| 9 | 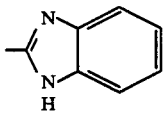 | $-O-CH_2-CH(CH_3)_2$ | O | $-Cl$ | $-H$ | $-H$ | $-CH_3$ |
| 10 | 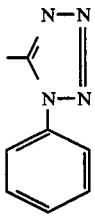 | $-OC_2H_5$ | O | $-CH_3$ | $-H$ | $-H$ | $-H$ |
| 11 | 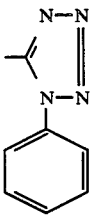 | $-OC_2H_5$ | O | $-H$ | $-H$ | $-H$ | $-H$ |
| 12 | 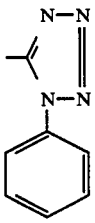 | $-O-CH(CH_3)_2$ | O | $-H$ | $-H$ | $-H$ | $-H$ |

-continued
Examples of the compounds represented by the general formula (I)
| No. | A | X | Y | $R_4$ | $R_5$ | $R_6$ | $R_7$ |
|---|---|---|---|---|---|---|---|
| 13 | 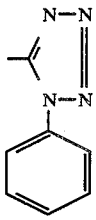 | $-O-CH_2-CH(CH_3)_2$ | O | —H | —H | —H | —H |
| 14 | 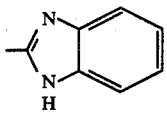 | $-O-CH_2-CH_2-CH_2-CH_3$ | O | —H | —H | —H | —H |
| 15 | 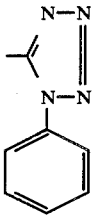 | —H | 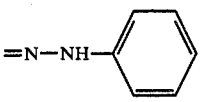 | —H | —H | —H | —H |
| 16 | 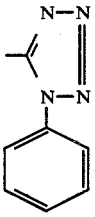 | $-CH_3$ | 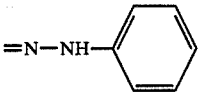 | —H | —H | —H | —H |
| 17 | 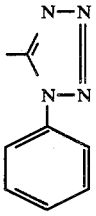 | 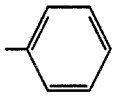 | 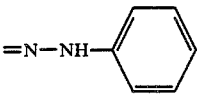 | —H | —H | —H | $-CH_3$ |
| 18 | 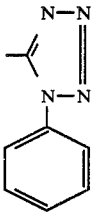 | —H | 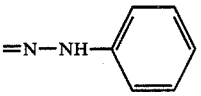 | —Cl | —H | —H | —H |
| 19 | 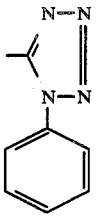 | —H | 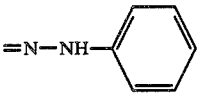 | $-CH_3$ | $-CH_3$ | $-CH_3$ | —H |

-continued
Examples of the compounds represented by the general formula (I)
| No. | A | X | Y | $R_4$ | $R_5$ | $R_6$ | $R_7$ |
|---|---|---|---|---|---|---|---|
| 20 | 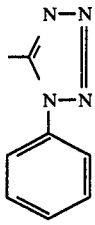 | —H | 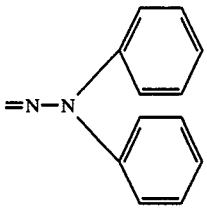 | —H | —H | —H | —H |
| 21 | 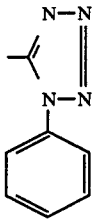 | —H | 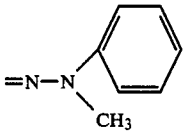 | —H | —H | —H | —H |
| 22 | 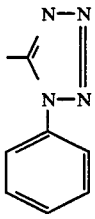 | —H | =N—N(CH$_3$)$_2$ | —H | —H | —H | —H |
| 23 | 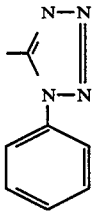 | —H | 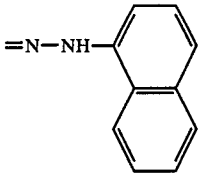 | —H | —H | —H | —H |
| 24 | 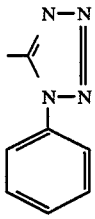 | —H | 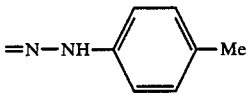 | —H | —H | —H | —H |
| 25 | 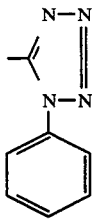 | —H | 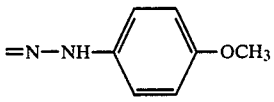 | —H | —H | —H | —H |
| 26 | 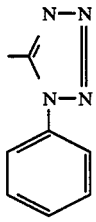 | —H | 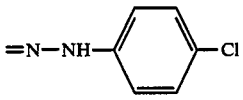 | —H | —H | —H | —H |

-continued
Examples of the compounds represented by the general formula (I)
| No. | A | X | Y | $R_4$ | $R_5$ | $R_6$ | $R_7$ |
|---|---|---|---|---|---|---|---|
| 27 | 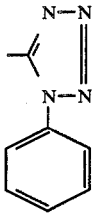 | —H | 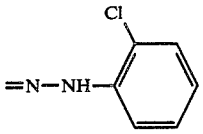 | —H | —H | —H | —H |
| 28 | 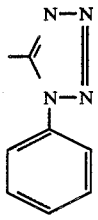 | —H | 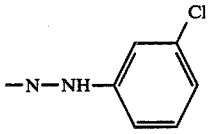 | —H | —H | —H | —H |
| 29 | 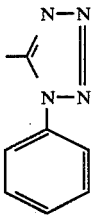 | —H | 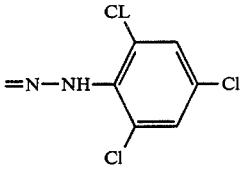 | —H | —H | —H | —H |
| 30 | 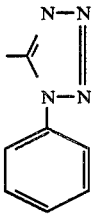 | —H | 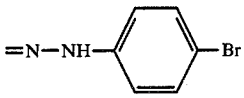 | —H | —H | —H | —H |
| 31 | 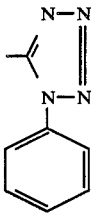 | —H | 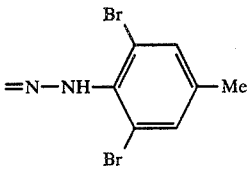 | —H | —H | —H | —H |
| 32 | 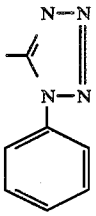 | —H | 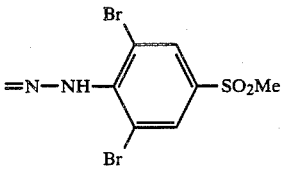 | —H | —H | —H | —H |

-continued
Examples of the compounds represented by the general formula (I)
| No. | A | X | Y | $R_4$ | $R_5$ | $R_6$ | $R_7$ |
|---|---|---|---|---|---|---|---|
| 33 | 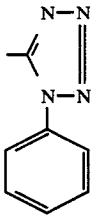 | —H | 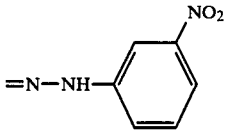 | —H | —H | —H | —H |
| 34 | 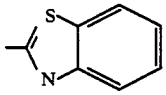 | —H | 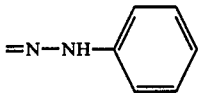 | —H | —H | —H | —H |
| 35 | 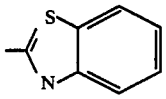 | —H | 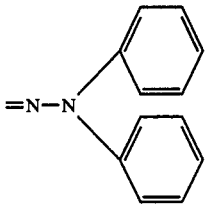 | —H | —H | —H | —H |
| 36 | 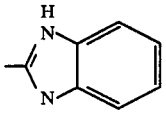 | —H | 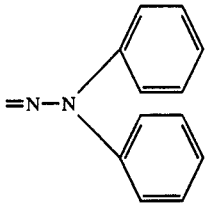 | —H | —H | —H | —H |
| 37 | 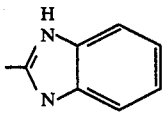 | —H | 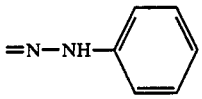 | —H | —H | —H | —H |
| 38 | 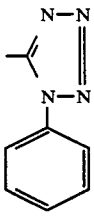 | —$OCH_3$ | O | —H | —H | —H | —H |
| 39 | 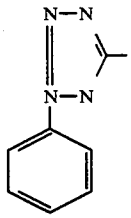 | —H | 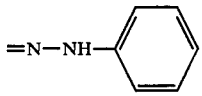 | —H | —Cl | —H | —H |
| 40 | 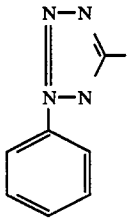 | —$CH_3$ | 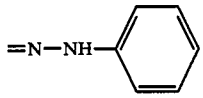 | —H | —Cl | —H | —H |

-continued
Examples of the compounds represented by the general formula (I)
| No. | A | X | Y | $R_4$ | $R_5$ | $R_6$ | $R_7$ |
|---|---|---|---|---|---|---|---|
| 41 | 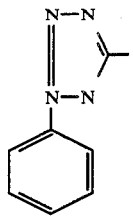 | —H | 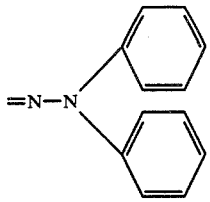 | —H | Br | —H | —H |
| 42 | 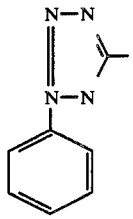 | —H | 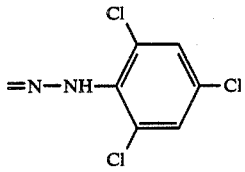 | —H | —Cl | —H | —H |
| 43 | 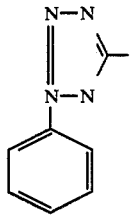 | —H | 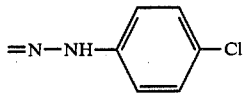 | —H | $—CH_3$ | —H | —H |
| 44 | 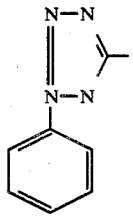 | —H | 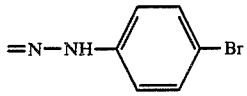 | —H | $—CH_3$ | —H | —H |
| 45 | 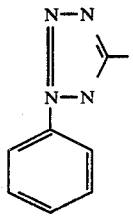 | —H | 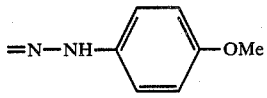 | —H | $—CH_3$ | —H | —H |
| 46 | 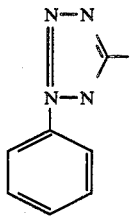 | —H | 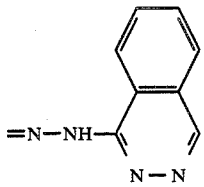 | —H | —Cl | —H | —H |

-continued
Examples of the compounds represented by the general formula (I)
| No. | A | X | Y | $R_4$ | $R_5$ | $R_6$ | $R_7$ |
|---|---|---|---|---|---|---|---|
| 47 | 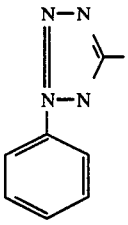 | —H | $=N-N(CH_3)_2$ | —H | —Cl | —H | —H |
| 48 | 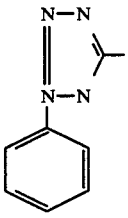 | —H | 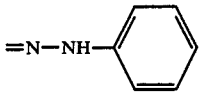 | —H | —H | —H | $—CH_3$ |
| 49 | 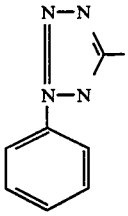 | —H | 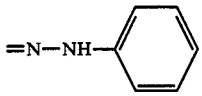 | —H | 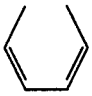 | | —H |
| 50 | 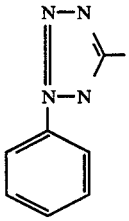 | —H | 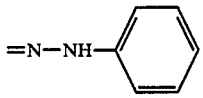 | 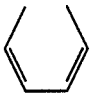 | | —H | —H |
| 51 | 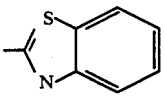 | —H | 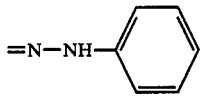 | —H | —H | —H | —H |
| 52 | 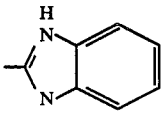 | —H | 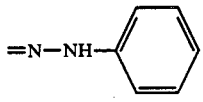 | —H | —H | —H | —H |
| 53 | 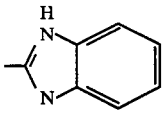 | —H | 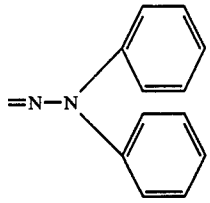 | —H | —H | —H | —H |
| 54 | 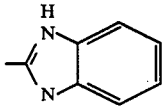 | —H | 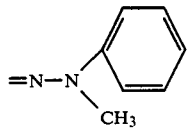 | —H | —H | —H | —H |

-continued

| Examples of the compounds represented by the general formula (I) | | | | | | | |
|---|---|---|---|---|---|---|---|
| No. | A | X | Y | $R_4$ | $R_5$ | $R_6$ | $R_7$ |
| 55 | 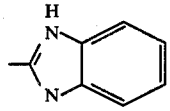 | —H | 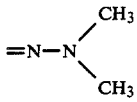 | —H | —H | —H | —H |

The following are synthesis examples of the antifoggant precursors used in this invention.

SYNTHESIS EXAMPLE 1

[Synthesis of the illustrative compound (2)]

7.46 g of 5-chloromethylsalicylic acid and 7.12 g of 1-phenyl-5-mercaptotetrazole were dissolved in 100 ml of dioxane and 5.5 ml of triethylamine was added dropwise thereto with stirring. After stirring at room temperature for 2 hours, precipitated triethylamine hydrochloride was filtered and filtrate was concentrated under reduced pressure. The residue was recrystallized from benzene-cyclohexene mixed solvent.

Yield: 5.7 g.

Melting point: 142°–143° C.

Elementary analysis: Calcd.: C, 54.87%. H, 3.68%; N, 17.06%. Found: C, 54.86%; H, 3.58%; N, 17.00%.

SYNTHESIS EXAMPLE 2

[Synthesis of the illustrative compound (4)]

5.28 g of methyl 5-chloromethylsalicylate and 1.78 g of 1-phenyl-5-mercaptotetrazole were dissolved in 30 ml of dioxane, followed by adding thereto dropwise 1.39 ml of triethylamine with stirring. After carrying out the reaction for 3 hours at room temperature, the reaction mixture was treated in the same manner as Synthesis Example 1.

Yield: 2.78 g.

Melting point: 106.5°–107.5° C.

Elementary analysis: Calcd.: C, 56.13%; H, 4.12%; N, 16.36%. Found: C, 56.13%; H, 4.10%; N, 16.31%.

SYNTHESIS EXAMPLE 3

[Synthesis of the illustrative compound (15)]

(a)

Synthesis of an intermediate:
1-phenyl-5-(3-formyl-4-hydroxybenzylthio)tetrazole 25.6 g of 5-chloromethylsalicylaldehyde and 26.7 g of 1-phenyl-5-mercaptotetrazole were dissolved in 250 ml of dioxane. Then, internal temperature of the solution was lowered to 20° C. or less with ice water and thereto was added dropwise 20.8 ml of triethylamine with stirring followed by stirring at room temperature for 2 hours. After completion of the reaction, the precipitated salt was filtered off and the filtrate was concentrated under reduced pressure. Thus obtained residue was dissolved in 500 ml of ethyl acetate and then washed with water and the organic layer was dried over anhydrous sodium sulfate. Thereafter sodium sulfate was filtered off and the solvent was distilled out under reduced pressure. The residue was recrystallized from a mixed solvent of ethyl acetate and cyclohexane.

Yield: 37.2 g.

Melting point: 121°–122° C.

(b)

Synthesis of the illustrative compound (15)

To 5.41 g of phenylhydrazine was added 100 ml of ethanol and thereto was added 15.6 g of 1-phenyl-5-(3-formyl-4-hydroxybenzylthio)tetrazole obtained in the above (a) under stirring and cooling with ice water. The stirring was continued for 2 hours. The precipitated crystal was filtered and washed with ethanol and then recrystallized from benzene to obtain the illustrative compound (15).

Yield: 15.91 g.

Melting point: 174.5°–176.0° C.

Elementary analysis: Calcd.: C, 62.67%; H, 4.51%; N, 20.88%. Found: C, 62.60%; H, 4.65%; N, 20.81%.

Other antifoggant precursors used in this invention may also be readily prepared in nearly the same manner as in these synthesis examples.

The antifoggant precursors used in this invention may be incorporated in silver halide emulsion layer or water-permeable contiguous colloid layer such as overcoat or undercoat layer for the emulsion layer of photographic light-sensitive materials.

The antifoggant precursor can be dissolved in a solvent miscible with water such as DMF, methanol, ethanol or the like and then be added to and mixed with the silver halide emulsion or the colloid dispersion before coating.

It is also possible to add the antifoggant precursor which has been dispersed in a latex to the silver halide emulsion or the colloid dispersion by the method as shown in Japanese Patent Unexamined Publication No. 137131/78.

When the antifoggant precursor is added to a silver halide emulsion, the solution of the precursor may be added at any stage of preparation of the emulsion but preferably it is added just before coating of the emulsion.

Concentration of the antifoggant precursor according to this invention varies depending on the kind of the compound and location of the compound in the photographic light-sensitive materials.

When the antifoggant precursor is added to a silver halide emulsion layer, amount of the precursor is generally 0.1–100 mmols (millimols), preferably 0.5–50 mmols for one mol of silver halide. The precursor may be used in the higher concentration when it is added to a separate colloid layer which is in contact or is brought into contact with the silver halide emulsion layer at the time of development.

The photographic light-sensitive materials containing the antifoggant according to this invention may be developed with a common developing solution after exposure.

The photographic light-sensitive materials developed according to this solution may be stabilized with common fixing or stabilizing solution.

Silver halide emulsions usable in this invention may be any kinds of emulsions, e.g., spectrally sensitized or un-sensitized emulsions, X-ray emulsions, infrared-sensitive emulsions and the like. Moreover, these may be high-speed negative emulsions or low-speed positive emulsions and furthermore may be of orthochromatic or panchromatic type.

As the silver-sensitive silver salts there may be used various silver salts such as silver bromide, silver iodide, silver chloride or mixed silver halides (silver chlorobromide, silver iodobromide, etc.).

Silver halide may be dispersed in ordinary hydrophilic colloids such as gelatin, casein, polyvinyl alcohol, carboxymethylcellulose, etc., but gelatin is preferred.

The silver halide emulsions can be chemically or optically sensitized and can be chemically sensitized by ripening in the presence of a small amount of a sulfur-containing compound (e.g., allyl thiocyanate, allyl thiourea, sodium thiosulfate, etc.).

The emulsions may also be sensitized with a reducing agent (e.g., tin compounds disclosed in French Pat. No. 1,146,955 and U.S. Pat. No. 2,487,850 and imino-aminomethanesulfinic acid compounds disclosed in British Pat. No. 789,823) and a small amount of noble metals (e.g., gold, platinum, palladium, iridium, ruthenium, rhodium etc.).

The emulsion may also be optically sensitized with cyanine dyes and merocyanine dyes.

Other additives such as development accelerator, sensitizer, antioxidant, etc. may also be added to the silver halide emulsion layer or other water permeable colloid layers.

Furthermore, the antifoggant precursor according to this invention may be used in combination with other antifoggants or other antifoggant precursors.

The following examples will illustrate this invention.

EXAMPLE 1

A gelatin silver iodobromide having a composition of silver bromide 65.6 mol %, silver chloride 34.0 mol % and silver iodide 0.5 mol % and having an average grain size of 0.45 μm was prepared by the neutral single jet method. After physical ripening the emulsion was desalted by washing with water followed by addition of gelatin, then sodium thiosulfate to carry out chemical sensitization and thereafter, a sensitizing dye, a stabilizer, a surfactant and a hardener to obtain a finished emulsion.

The thus obtained gelatin-silver halide emulsion was divided into 16 portions. To each of 10 portions was added the above-illustrated antifoggant precursor compound as shown in Table 1 in an amount of 2 mmols per one mol of silver halide. For comparative purpose, to each of other 3 portions was added 1-phenyl-5-mercaptotetrazole (comparison A), 2-mercaptobenzothiazole (comparison B) and 2-mercaptobenzimidazole (comparison C) in an amount of 2 mmols per one mol of silver halide, respectively. To each of other 2 portions was added the following anti-foggant precursors (comparison D and comparison E) as disclosed in U.S. Pat. No. 3,674,478 in an amount of 2 mmols per one mol of silver halide, respectively.

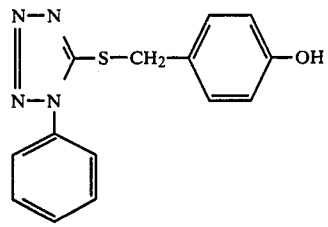

Comparison D

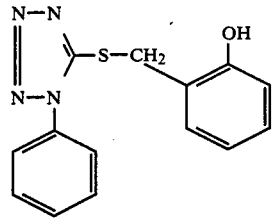

Comparison E

No compound was added to the last one portion (comparison F). These antifoggant precursors (or antifoggants) were added immediately before coating of the emulsions.

On a photographic base having polyethylene layer on both sides was coated each of these 16 emulsions at a coating weight of 2.5 g/m$^2$ in terms of silver nitrate and 6.0 g/m$^2$ in terms of gelatin and these samples were dried. These samples were warmed at 50° C. for one day. A part of each sample was exposed through a step wedge and then was developed with the following developing solution at 20° C. for 90 seconds, then subjected to stopping, fixing and water-washing treatments and dried. Then, photographic characteristics were obtained.

| Developing solution | |
|---|---|
| Water | 750 ml |
| Methol | 1.0 g |
| Hydroquinone | 4.0 g |
| Sodium sulfate | 15.0 g |
| Sodium carbonate (monohydrate) | 26.7 g |
| Potassium bromide | 0.7 g |
| Water to make 1,000 ml | |
| pH was adjusted to 10.5. | |

Another part of each sample was developed with the above developing solution at 30° C. for 6 minutes without exposure and another part was developed with the above developing solution raised to a pH of 12.0 without exposure and further another part was developed with the above developing solution raised to a pH of 13.0 without exposure. Each sample was examined on development fog. The results are shown in Table 1.

TABLE 1

| | Anti-foggant pre-cursors | Relative sensi-tivity | Gamma | Fog pH 10.5 | Fog pH 12.0 | Fog pH 13.0 |
|---|---|---|---|---|---|---|
| ① | (1) | 131.8 | 2.40 | 0.05 | 0.07 | 0.09 |
| ② | (38) | 173.8 | 2.70 | 0.06 | 0.07 | 0.09 |
| ③ | (2) | 130.5 | 2.30 | 0.05 | 0.06 | 0.09 |
| ④ | (4) | 141.3 | 2.40 | 0.05 | 0.06 | 0.09 |
| ⑤ | (5) | 175.0 | 2.70 | 0.06 | 0.07 | 0.09 |
| ⑥ | (7) | 177.5 | 2.72 | 0.05 | 0.07 | 0.09 |
| ⑦ | (11) | 144.5 | 2.60 | 0.06 | 0.07 | 0.09 |
| ⑧ | (12) | 141.4 | 2.55 | 0.05 | 0.06 | 0.09 |
| ⑨ | (13) | 173.8 | 2.70 | 0.06 | 0.07 | 0.09 |
| ⑩ | (14) | 162.2 | 2.49 | 0.06 | 0.07 | 0.08 |

TABLE 1-continued

| | Antifoggant precursors | Relative sensitivity | Gamma | Fog pH 10.5 | Fog pH 12.0 | Fog pH 13.0 |
|---|---|---|---|---|---|---|
| ⑪ | Comparison A | 100.0 | 2.20 | 0.05 | 0.07 | 0.10 |
| ⑫ | Comparison B | 98.5 | 2.10 | 0.05 | 0.05 | 0.10 |
| ⑬ | Comparison C | 96.0 | 2.05 | 0.05 | 0.05 | 0.10 |
| ⑭ | Comparison D | 120.0 | 2.25 | 0.05 | 0.07 | 0.10 |
| ⑮ | Comparison E | 125.5 | 2.30 | 0.05 | 0.07 | 0.10 |
| ⑯ | Comparison F | 182.0 | 2.60 | 0.15 | 0.25 | 0.50 |

EXAMPLE 2

The silver iodochlorobromide-gelatin emulsion prepared in the same manner as in Example 1 was chemically sensitized and then thereto were added a sensitizing dye, a surfactant, and a hardener to obtain a finished emulsion.

Thus obtained gelatin-silver halide emulsion was divided to 7 portions and the illustrative antifoggant precursor compound as shown in Table 2 was added in an amount of 2 mmols for one mol of silver halide to each of 1–4 portions.

For comparison, to one of other portions was added 1-phenyl-5-mercaptotetrazole (comparison A) and to further one of other portions was added the following antifoggant precursor (comparison B) disclosed in U.S. Pat. No. 3,674,478 in an amount of 2 mmols for one mol of silver halide, respectively.

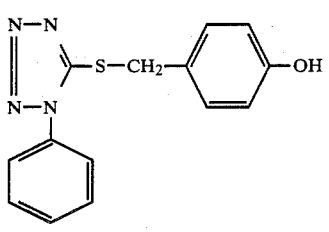

(Comparison B)

No compound was added to the last one portion (comparison C).

These antifoggant precursors (or antifoggants) were added immediately before coating of the emulsions.

In the same manner as in Example 1 these emulsions were coated at intervals of certain hours with keeping them at 40° C. to examine change with time in stability of the emulsions.

These samples were warmed at 40° C. for 5 days and photographic characteristics of them were evaluated in the same manner as in Example 1.

Next, these samples were developed with the same developing solution as used in Example 1 at a pH of 10.5 for 6 minutes at 30° C. without exposure and degree of fog formed thereon were examined. The results obtained are shown in Table 2.

TABLE 2

| | Antifoggant precursors | Stability of emulsion with time: Addition immediately before coating (0 hr) Relative sensitivity | Fog | After one hours Relative sensitivity | Fog | After 4 hours Relative sensitivity | Fog |
|---|---|---|---|---|---|---|---|
| ① | (38) | 173.8 | 0.06 | 173.0 | 0.06 | 172.5 | 0.06 |
| ② | (5) | 175.0 | 0.06 | 174.0 | 0.06 | 174.5 | 0.06 |
| ③ | (7) | 177.5 | 0.05 | 177.0 | 0.05 | 176.0 | 0.05 |
| ④ | (13) | 173.8 | 0.06 | 173.8 | 0.06 | 172.9 | 0.06 |
| ⑤ | Comparison A | 100.0 | 0.05 | 98.5 | 0.05 | 93.6 | 0.05 |
| ⑥ | Comparison B | 120.0 | 0.05 | 110.5 | 0.05 | 101.0 | 0.05 |
| ⑦ | Comparison C | 182.0 | 0.15 | 184.0 | 0.15 | 183.8 | 0.18 |

EXAMPLE 3

A silver iodobromide gelatin emulsion having an average grain size of 0.45 μm and having a composition of silver bromide 65.5 mol %, silver chloride 34.0 mol % and silver iodide 0.5 mol % was prepared by neutral single jet method. After physical ripening, the emulsion was desalted by washing with water followed by adding gelatin and then sodium thiosulfate to perform chemical sensitization. Thereafter, a sensitizing dye, a stabilizer, surfactant and a hardener were added to complete an emulsion.

This gelatin-silver halide emulsion was divided into 18 portions and to each of them was added the illustrative antifoggant precursor compound as shown in Table 3 in an amount of 2 mmols for one mol of silver halide.

Each of these 18 emulsions was coated on a photographic base having polyethylene layers on both sides at a coverage of 2.5 g/m$^2$ in terms of silver nitrate and 6.0 g/m$^2$ in terms of gelatin and then was dried.

Photographic characteristics of these 18 samples were obtained in the same manner as in Example 1 and the results are shown in Table 3.

TABLE 3

| Sample No. | Antifoggant precursors | Relative sensitivity | Gamma | Fog pH 10.5 | Fog pH 12.0 | Fog pH 13.0 |
|---|---|---|---|---|---|---|
| ① | (15) | 151.8 | 2.60 | 0.05 | 0.07 | 0.09 |
| ② | (18) | 150.0 | 2.61 | 0.05 | 0.07 | 0.10 |
| ③ | (20) | 173.0 | 2.70 | 0.06 | 0.07 | 0.09 |
| ④ | (21) | 171.0 | 2.69 | 0.06 | 0.07 | 0.09 |
| ⑤ | (22) | 164.5 | 2 60 | 0.05 | 0.07 | 0.09 |
| ⑥ | (24) | 165.1 | 2.65 | 0.06 | 0.07 | 0.09 |
| ⑦ | (25) | 136.8 | 2.66 | 0.05 | 0.07 | 0.09 |
| ⑧ | (26) | 165.1 | 2.68 | 0.06 | 0.08 | 0.10 |
| ⑨ | (27) | 170.0 | 2.66 | 0.05 | 0.07 | 0.09 |
| ⑩ | (29) | 176.5 | 2.65 | 0.05 | 0.07 | 0.09 |
| ⑪ | (30) | 159.5 | 2.60 | 0.06 | 0.07 | 0.09 |
| ⑫ | (31) | 176.0 | 2.61 | 0.06 | 0.07 | 0.09 |
| ⑬ | (32) | 155.5 | 2.51 | 0.067 | 0.07 | 0.09 |
| ⑭ | (34) | 150.3 | 2.35 | 0.05 | 0.08 | 0.10 |
| ⑮ | (37) | 135.0 | 2.38 | 0.05 | 0.07 | 0.09 |
| ⑯ | (39) | 154.3 | 2.60 | 0.06 | 0.07 | 0.09 |
| ⑰ | (42) | 175.7 | 2.65 | 0.06 | 0.07 | 0.09 |
| ⑱ | (51) | 152.5 | 2.35 | 0.06 | 0.07 | 0.09 |

EXAMPLE 4

A silver iodochlorobromide-gelatin emulsion prepared in the same manner as in Example 1 was subjected to chemical sensitization and then a sensitizing dye, a surfactant, and a hardener were added to complete an emulsion in the same manner as in Example 1.

Thus obtained gelatin-silver halide emulsion was divided into 7 portions and to each of them was added the illustrative antifoggant precursor compound as shown in Table 4 in an amount of 2 mmols for one mol of silver halide.

These antifoggant precursors were added immediately before coating of the emulsions.

These emulsions were kept at 40° C. and coated at intervals of certain hours to examine change with time of stability of the emulsions. Coating method was the same as in Example 1.

Thus obtained samples were warmed at 40° C. for 5 days and photographic characteristics thereof were obtained in the same manner as in Example 1.

Next, these samples were developed at 30° C. for 6 minutes with the same developing solution as used in Example 1 with a pH 10.5 without exposure and degree of fog formed thereon was examined. The results are shown in Table 4.

TABLE 4

| | | Stability of emulsion with time | | | | | |
|---|---|---|---|---|---|---|---|
| | | Addition immediately before coating (0 hr) | | After one hour | | After 4 hours | |
| | Antifoggant precursors | Relative sensitivity | Fog | Relative sensitivity | Fog | Relative sensitivity | Fog |
| ① | (15) | 151.8 | 0.05 | 151.5 | 0.05 | 151.6 | 0.05 |
| ② | (20) | 173.0 | 0.06 | 173.0 | 0.06 | 172.5 | 0.06 |
| ③ | (21) | 171.0 | 0.06 | 170.8 | 0.06 | 171.0 | 0.06 |
| ④ | (24) | 165.1 | 0.06 | 165.0 | 0.06 | 159.3 | 0.06 |
| ⑤ | (27) | 170.0 | 0.05 | 170.0 | 0.05 | 170.0 | 0.05 |
| ⑥ | (29) | 176.5 | 0.05 | 176.1 | 0.05 | 176.0 | 0.05 |
| ⑦ | (31) | 176.0 | 0.06 | 176.0 | 0.06 | 175.0 | 0.06 |

As is clear from Tables 1 and 3, the compounds used in this invention do not cause undesirable reduction of sensitivity in comparison with the compounds A, B, C, D, and E used for comparison as shown by the data on relative sensitivity (the sensitivity of the sample containing compound A is assumed to be 100.0.).

It is further recognized that the compounds of this invention bring about substantially no softening of tone (decrease in $\gamma$-value) and have no adverse effect on photographic characteristics.

Furthermore, when the compounds of this invention are used, the level of fog formation is very low which is comparable to use of the comparative compound A. From this it can be recognized that the compounds of this invention are effectively hydrolyzed in the developing solution to release antifoggants.

In addition it is also recognized from Tables 2 and 4 that the antifoggant precursors of this invention are superior to the comparative compounds A and B in stability of emulsion with time.

What is claimed is:

1. A silver halide photographic light-sensitive material which comprises a support and at least one photographic layer coated thereon, wherein at least one of silver halide emulsion layer and/or water-permeable contiguous colloid layer contain at least one development fog inhibiting compound represented by the following general formula (I) or (II):

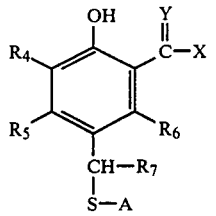

(I)

wherein Y represents oxygen atom or

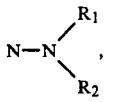

X represents $OR_3$ when Y is oxygen atom and $R_3$ when Y is

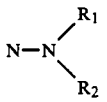

where $R_1$ and $R_2$ each represent hydrogen atom, alkyl group or aryl group and $R_3$ represents hydrogen atom, alkyl group or phenyl group; $R_4$, $R_5$ and $R_6$ each represent hydrogen atom, halogen atom, alkyl group, carboxyl group, alkoxycarbonyl group or phenyl group, $R_4$ and $R_5$ may form together a benzene ring; $R_7$ represents hydrogen atom, alkyl group or phenyl group and A represents a heterocyclic group of mercapto antifoggant;

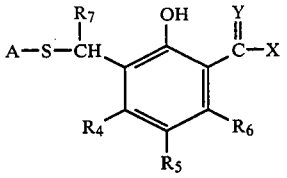

(II)

wherein, X, Y, $R_4$, $R_5$, $R_6$ and $R_7$ and A are the same as defined for general formula (I) and $R_4$ and $R_5$ or $R_5$ and $R_6$ may form together a benzene ring.

2. A silver halide photographic light-sensitive material according to claim 1 wherein the alkyl groups of $R_1$–$R_7$ for the general formulas (I) and (II) are substituted or unsubstituted alkyl groups of 1–10 carbon atoms.

3. A silver halide photographic light-sensitive material according to claim 1 wherein A in the general formulas (I) and (II) is selected from tetrazole ring, 1,2,4-triazole ring, benzoxazole ring, benzthiazole ring, benzimidazole ring, pyridine ring and pyrimidine ring.

4. A light-sensitive material according to claim 1, wherein content of the compound is 0.1 to 100 mmols for one mol of silver halide.

5. A process for forming images which comprises imagewise exposing the photographic light-sensitive material as defined in claim 1 and developing it.

6. A silver halide photographic light-sensitive material according to claim 1 wherein there is employed a compound of formula (I).

7. A silver halide photographic light-sensitive material according to claim 1 wherein there is employed a compound of formula (II).

* * * * *